US006378225B1

(12) United States Patent
Slingo

(10) Patent No.: US 6,378,225 B1
(45) Date of Patent: Apr. 30, 2002

(54) HAIR DRYER EMPLOYING FAR-INFRARED RADIATION

(76) Inventor: Fred M. Slingo, c/o 21st Century Innovative Products, L.L.C. 905 Armstrong St., Algonquin, IL (US) 60102

( * ) Notice: Subject to any disclaimer, the term of this patent is extended or adjusted under 35 U.S.C. 154(b) by 0 days.

(21) Appl. No.: 09/824,066

(22) Filed: Apr. 2, 2001

(51) Int. Cl.[7] ..... A45D 20/00

(52) U.S. Cl. ..... 34/97; 34/269; 34/90; 392/375; 392/385

(58) Field of Search ..... 34/90, 96, 97, 34/98, 99, 266, 267, 269; 392/375, 379, 380, 381, 382, 383, 384, 385

(56) References Cited

U.S. PATENT DOCUMENTS 4,316,077 A * 2/1982 Carlson ..... 219/370
4,636,617 A * 1/1987 Petersen et al. ..... 219/375
4,757,183 A * 7/1988 Karey et al. ..... 219/365
5,077,461 A * 12/1991 Hasegawa ..... 219/553
5,996,243 A * 12/1999 Chang et al. ..... 34/97
6,205,677 B1 3/2001 Yune

* cited by examiner

*Primary Examiner*—Pamela Wilson
(74) *Attorney, Agent, or Firm*—Rockey, Milnamow & Katz, Ltd.

(57) ABSTRACT

Employing a radiator made of a ceramic adapted when heated to radiate far-infrared radiation, a hair dryer comprises an elongate body, which has an inlet end defining an inlet and an outlet end defining an outlet, a fan, which is adapted when driven to draw air into the inlet, to move air through the elongate body, and to blow air from the outlet, an electrical motor, which is adapted when energized to drive the fan, and an electrical heater, which is mounted within the elongate body, between the fan and the outlet. The ceramic radiator, which is tubular, is mounted within the elongate body, between the fan and the outlet and near the electrical heater, which is configured as an elongate coil deployed around the ceramic radiator and which is adapted when energized to heat air pulled through the elongate body by the fan and to heat the ceramic radiator.

6 Claims, 1 Drawing Sheet

HAIR DRYER EMPLOYING FAR-INFRARED RADIATION

FIELD OF THE INVENTION

This invention pertains to a hair dryer employing a radiator made of a ceramic adapted when heated to radiate far-infrared radiation.

BACKGROUND OF THE INVENTION

Conventionally, a hair dryer employs a heating wire, such as a nickel-chromium (Ni—Cr) wire, and relies upon heat convection only to dry a user's hair.

As exemplified in U.S. Pat. No. 6,205,677 (from International Application No. PCT/KR99/00336) it has been known for a hair dryer to employ a heater radiating far-infrared radiation. As exemplified therein, the heater radiating far-infrared radiation is a halogen heater, which comprises a heating wire within a gas-filled, quartz tube. Such a hair dryer employs far-infrared radiation as well as heat convection to dry a user's hair.

Certain ceramics containing silica oxide ($SiO_2$) and aluminum oxide ($AL_2O_2$) are known to radiate far-infrared radiation when heated. In some publications, because of biological and physiological effects attributed to far-infrared radiation by researchers in Japan, Korea, and elsewhere, such ceramics that radiate far-infrared radiation are called bio-ceramics. Also, in some publications, far-infrared radiation is called by a "FIR" acronym.

Hereinbefore and hereinafter, although far-infrared radiation refers to a much wider range in astronomy and astrophysics, far-infrared radiation refers to electromagnetic radiation having a wave length in a range from approximately six microns to approximately fourteen microns.

SUMMARY OF THE INVENTION

This invention provides a hair dryer employing a radiator made of a ceramic, such as a bio-ceramic, which is adapted when heated to radiate far-infrared radiation. A ceramic suitable for the radiator is available commercially from Tae Yang Ind. Co. of Majungong 87-1, Sugu, Inchon, Korea, under its CELAMIN trademark.

The hair dryer comprises an elongate body, which has an inlet end defining an inlet and an outlet end defining an outlet. The hair dryer further comprises a fan, which is adapted when driven to draw air into the inlet, to move air through the elongate body, and to blow air from the outlet, and an electrical motor, which is adapted when energized to drive the fan. The hair dryer further comprises an electrical heater, which is mounted within the elongate body, between the fan and the outlet.

This invention contemplates that the ceramic radiator is mounted to the elongate body, near the electrical heater, and that the electrical heater is adapted when energized to heat air pulled through the elongate body by the fan and to heat the ceramic radiator. Preferably, the ceramic radiator is tubular and is mounted within the elongate body and the electrical heater is configured as an elongate coil, which is deployed around the ceramic radiator.

For a discussion of certain effects attributed to far-infrared radiation, particularly in a context of a hair dryer, the disclosure of U.S. Pat. No. 6,205,677, supra, is incorporated herein by reference.

DETAILED DESCRIPTION OF THE PREFERRED EMBODIMENT

Figure 1:
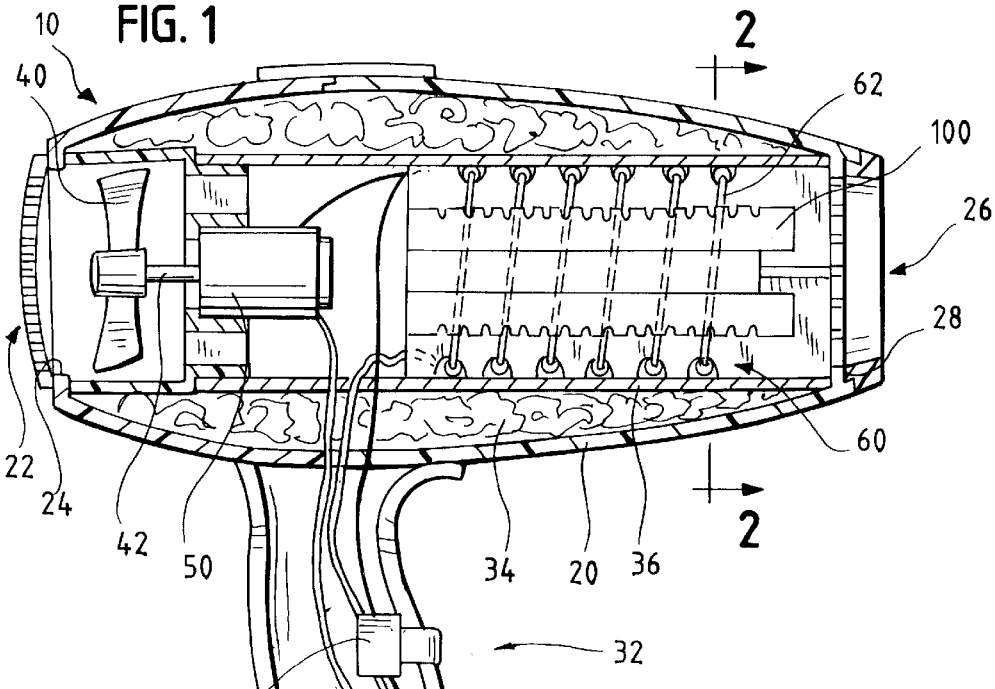
FIG. 1 is a longitudinal, cross-sectional view of a hair dryer employing a ceramic radiator, as discussed above, and constituting a preferred embodiment of this invention.
Figure 2:
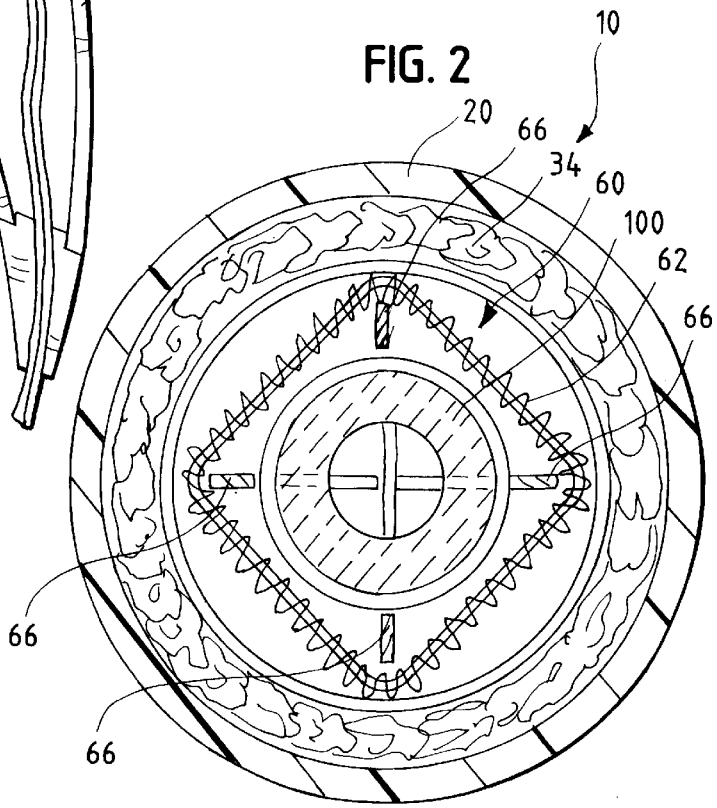
FIG. 2 is a transverse, cross-sectional view taken along line 2–2 of FIG. 1, in a direction indicated by arrows.

As shown, a hair dryer 10 employing a ceramic radiator 100, as discussed above, constitutes a preferred embodiment of this invention. When heated in a manner to be later described, the ceramic radiator 100 radiates far-infrared radiation, i.e., electromagnetic radiation having a wave length in a range from approximately six microns to approximately fourteen microns.

The hair dryer 10 comprises an elongate body 20, which has an inlet end 22 defining an inlet 24 and an outlet end 26 defining an outlet 28 and which has an attached handle 30 mounting an electrical switching means 32. The elongate body 20 is lined with thermally insulative materials 34, 36, of types used conventionally in hair dryers.

The hair dryer 10 further comprises a fan 40, which is adapted when driven to draw air into the inlet 24, to move air through the elongate body 20, and to blow air from the outlet 28, and an electrical motor 50, which is adapted when energized to drive the fan 40 via a rotary shaft 42. The hair dryer 10 further comprises an electrical heater 60, which is mounted within the elongate body 20, between the fan 40 and the outlet 28 and which comprises an elongate coil 62 of a heating wire, such as a nickel-chromium (Ni—Cr) wire. The elongate coil 62 is mounted within the elongate body 20 via two crossed mounting brackets 66.

The fan 40 and the electrical heater 60 are controlled by the electrical switching means 32, through which the fan 40 and the electrical heater 60 are connectable to a source (not shown) of electrical power. The electrical switching means 32 may comprise a single switch (not shown) to control the fan and to control the electrical heater 60 or, if desired, a separate switch 44 to control the fan 40 and a separate switch 64 to control the electrical heater 60. The fan 40 and the electrical heater 60 may be thus controlled at a single setting for each or at plural, selectable settings for one or for both.

The ceramic radiator 100, which is tubular, is mounted within the elongate body 20, between the fan 40 and the outlet 28. The ceramic radiator 100 is suspended within the elongate coil 62, which is deployed around the ceramic radiator 100, via the previously mentioned brackets 66. When the fan 40 and the electrical heater 60 are energized, the electrical heater 60 is adapted to heat air moved through the elongate body 20 by the fan 40 and to heat the ceramic radiator 100, which radiates far-infrared radiation.

As compared to known hair dryers relying upon heat convection only, the hair dryer 10 can be effectively operated at lower temperatures and with higher efficiencies.

What is claimed is:

1. A hair dryer employing a radiator made of a ceramic adapted when heated to radiate far-infrared radiation, the hair dryer comprising an elongate body, which has an inlet end defining an inlet and an outlet end defining an outlet, a fan, which is adapted when driven to draw air into the inlet, to move air through the elongate body, and to blow air from the outlet, an electrical motor, which is adapted when energized to drive the fan, and an electrical heater, which is mounted within the elongate body, between the fan and the outlet, the ceramic radiator being mounted to the elongate body, near the electrical heater, which is adapted when energized to heat air moved through the elongate body by the fan and to heat the ceramic radiator.

2. The hair dryer of claim 1 wherein the ceramic radiator is mounted within the elongate body, between the fan and the outlet.

3. A hair dryer employing a radiator made of a ceramic adapted when heated to radiate far-infrared radiation, the hair dryer comprising an elongate body, which has an inlet end defining an inlet and an outlet end defining an outlet, a fan, which is adapted when driven to draw air into the inlet, to move air through the elongate body, and to blow air from the outlet, an electrical motor, which is adapted when energized to drive the fan, and an electrical heater, which is mounted within the elongate body, between the fan and the outlet, the ceramic radiator being mounted within the elongate body, between the fan and the outlet and near the electrical heater, which is adapted when energized to heat air pulled through the elongate body by the fan and to heat the ceramic radiator, wherein the ceramic radiator is tubular and wherein the electrical heater is elongate and is deployed around the ceramic radiator.

4. The hair dryer of claim 3 wherein the electric heater is configured as an elongate coil deployed around the ceramic radiator.

5. A hair dryer employing a radiator made of a ceramic adapted when heated to radiate far-infrared radiation, the hair dryer comprising an elongate body, which has an inlet end defining an inlet and an outlet end defining an outlet, a fan, which is adapted when driven to draw air into the inlet, to move air through the elongate body, and to blow air from the outlet, an electrical motor, which is adapted when energized to drive the fan, and an electrical heater, which is mounted within the elongate body, between the fan and the outlet, the ceramic radiator being mounted within the elongate body, between the fan and the outlet and near the electrical heater, which is adapted when energized to heat air pulled through the elongate body by the fan and to heat the ceramic radiator, wherein the ceramic radiator is mounted within the elongate body, between the fan and the outlet, wherein the ceramic radiator is tubular and wherein the electrical heater is elongate and is deployed around the ceramic radiator.

6. The hair dryer of claim 5 wherein the electric heater is configured as an elongate coil deployed around the ceramic radiator.

* * * * *